US010483034B2

(12) United States Patent
Lee et al.

(10) Patent No.: US 10,483,034 B2
(45) Date of Patent: Nov. 19, 2019

(54) MANUFACTURING METHOD OF COIL-EMBEDDED INDUCTOR USING SOFT MAGNETIC MOLDING SOLUTION AND COIL-EMBEDDED INDUCTOR MANUFACTURED BY USING THE SAME

(71) Applicant: CHANG SUNG CO., LTD., Cheongju-si, Chungcheongbuk-do (KR)

(72) Inventors: Tae Kyung Lee, Incheon (KR); Seung Nam Yang, Uiwang-si (KR); Sung Jin Choi, Pyeongtaek-si (KR)

(73) Assignee: CHANG SUNG CO., LTD., Cheongju-si, Chungcheongbuk-Do (KR)

( * ) Notice: Subject to any disclaimer, the term of this patent is extended or adjusted under 35 U.S.C. 154(b) by 254 days.

(21) Appl. No.: 15/525,854

(22) PCT Filed: Mar. 7, 2017

(86) PCT No.: PCT/KR2017/002456
§ 371 (c)(1),
(2) Date: May 10, 2017

(87) PCT Pub. No.: WO2017/175974
PCT Pub. Date: Oct. 12, 2017

(65) Prior Publication Data

US 2018/0197679 A1 Jul. 12, 2018

(30) Foreign Application Priority Data

Apr. 7, 2016 (KR) ..... 10-2016-0042877

(51) Int. Cl.
*H01F 41/02* (2006.01)
*H01F 1/26* (2006.01)
(Continued)

(52) U.S. Cl.
CPC ..... *H01F 41/0246* (2013.01); *B22F 1/0011* (2013.01); *B22F 1/0014* (2013.01);
(Continued)

(58) Field of Classification Search
CPC ..... H01F 41/0246; H01F 41/04; H01F 3/08; H01F 27/255; H01F 27/327; C22C 33/0257
See application file for complete search history.

(56) References Cited

U.S. PATENT DOCUMENTS 3,834,038 A * 9/1974 Janda ..... B29B 13/065 219/686
7,427,909 B2 9/2008 Ono et al.
(Continued)

FOREIGN PATENT DOCUMENTS

KR 2008-0101771 A 11/2008
KR 101096958 B1 12/2011
(Continued)

OTHER PUBLICATIONS

Office Action (Grounds of Rejection) dated Jul. 17, 2017, by the Korean Patent Office in corresponding Korean Patent Application No. 10-2016-0042877, and an English Translation of the Office Action. (9 pages).

*Primary Examiner* — Anthony J Zimmer
*Assistant Examiner* — Ricardo D Morales
(74) *Attorney, Agent, or Firm* — Buchanan Ingersoll & Rooney PC

(57) ABSTRACT

An optimal condition is disclosed in which a composition of a soft magnetic molding solution includes 94 to 98 wt % of a soft magnetic powder and 2 to 6 wt % of an organic vehicle, in order to manufacture a coil-embedded inductor having various advantages such as high inductance, a low core loss, and high reliability. An exemplary manufacturing
(Continued)

method is provided of a coil-embedded inductor having a structure in which a part of a coil is embedded in a magnetic core, which includes preparing an organic vehicle, preparing a soft magnetic molding solution having the density of 5.5 to 6.5 g/cc by mix-milling a soft magnetic powder with the organic vehicle, positioning and fixing a part of the coil in the case, and forming the magnetic core by injecting and curing the soft magnetic molding solution into the case.

10 Claims, 2 Drawing Sheets

(51) Int. Cl.

| | |
|---|---|
| ***H01F 3/08*** | (2006.01) |
| ***H01F 27/255*** | (2006.01) |
| ***H01F 27/32*** | (2006.01) |
| ***B22F 1/00*** | (2006.01) |
| ***C22C 33/02*** | (2006.01) |
| ***B22F 3/22*** | (2006.01) |
| ***H01F 27/28*** | (2006.01) |
| ***H01F 41/04*** | (2006.01) |
| ***H01F 1/147*** | (2006.01) |
| ***H01F 17/04*** | (2006.01) |

(52) U.S. Cl.

CPC ..... *B22F 1/0062* (2013.01); *B22F 1/0074* (2013.01); *B22F 3/225* (2013.01); *C22C 33/0257* (2013.01); *H01F 1/26* (2013.01); *H01F 3/08* (2013.01); *H01F 27/255* (2013.01); *H01F 27/28* (2013.01); *H01F 27/327* (2013.01); *H01F 41/04* (2013.01); *B22F 2001/0066* (2013.01); *B22F 2301/35* (2013.01); *B22F 2304/10* (2013.01); *H01F 1/14758* (2013.01); *H01F 1/14766* (2013.01); *H01F 1/14791* (2013.01); *H01F 2017/048* (2013.01)

(56) References Cited

U.S. PATENT DOCUMENTS

| | | | | |
|---|---|---|---|---|
| 2005/0007232 | A1 | 1/2005 | Ono et al. | |
| 2005/0012581 | A1 | 1/2005 | Ono et al. | |
| 2008/0231401 | A1* | 9/2008 | Lee | B29C 45/0013 336/83 |
| 2008/0283188 | A1 | 11/2008 | Oda et al. | |
| 2009/0051475 | A1* | 2/2009 | Hsueh | H01F 17/04 336/83 |
| 2013/0323109 | A1* | 12/2013 | Takayama | B22F 1/02 419/27 |

FOREIGN PATENT DOCUMENTS

| | | | | |
|---|---|---|---|---|
| KR | 10-1165837 | B1 | 7/2012 | |
| WO | WO-2015009050 | A1 * | 1/2015 | H01F 1/14741 |

* cited by examiner

MANUFACTURING METHOD OF COIL-EMBEDDED INDUCTOR USING SOFT MAGNETIC MOLDING SOLUTION AND COIL-EMBEDDED INDUCTOR MANUFACTURED BY USING THE SAME

This application claims the benefit of priority of Korean Patent Application No. 10-2016-0042877 filed on Apr. 7, 2016, which is incorporated by reference in its entirety herein.

BACKGROUND OF THE INVENTION

Field of the Invention

The present invention relates to a manufacturing method of a coil-embedded inductor using a soft magnetic molding solution and a coil-embedded inductor manufactured using the same, and more particularly, to an optimal condition in which a composition of a soft magnetic molding solution includes 94 to 98 wt % of a soft magnetic powder and 2 to 6 wt % of an organic vehicle, in order to manufacture a coil-embedded inductor having various advantages such as high inductance, a low core loss, and high reliability.

Discussion of the Related Art

In general, magnetic cores are used in transformers, motors, inductors, and the like due to high permeability to concentrate a magnetic field line. Characteristics of the magnetic core may vary according to a shape of the magnetic core, an operating temperature of the magnetic core, and the like, but particularly, may vary according to materials forming the magnetic core and a composition thereof. In this regard, in Korean Patent Registration No. 1096958 (title of invention: magnetic core and core component using the same, hereinafter, referred to as prior art 1), there is provided a magnetic core obtained by curing a mixture of magnetic powder and a resin. The magnetic core has relative permeability of 10 or more in a magnetic field of $1000*10^3/4\pi$ [A/m] and a mixing ratio of the resin in the mixture is in a range of 30 volume % to 90 volume %.

SUMMARY OF THE INVENTION

An object to be achieved in the present invention is to solve a first problem of prior art 1 in which an excellent DC bias characteristic is shown, but reliability is not secured, a second problem of prior art 1 in which while pressure is applied to a molding article after completing a casting process, cracks in the molding article may occur, and a third problem in which a method of reducing a core loss is not provided.

Technical objects to be achieved in the present invention are not limited to the aforementioned objects, and other technical objects not described above will be apparently understood to those skilled in the art from the following disclosure of the present invention.

An aspect of the present invention provides a manufacturing method of a coil-embedded inductor having a structure in which a part of a coil is embedded in a magnetic core, the manufacturing method including: preparing an organic vehicle, preparing a soft magnetic molding solution having the density of 5.5 to 6.5 g/cc by mix-milling a soft magnetic powder with the organic vehicle, positioning and fixing a part of the coil in the case, and forming the magnetic core by injecting and curing the soft magnetic molding solution into the case, in which the soft magnetic molding solution is formed with a composition ratio of 94 to 98 wt % of the soft magnetic powder and 2 to 6 wt % of the organic vehicle.

The manufacturing method may further include adding a curing agent or a curing accelerator to the soft magnetic molding solution, between the preparing of the soft magnetic molding solution and the positioning and fixing of the part of the coil.

In the forming of the magnetic core, the soft magnetic molding solution may be cured in a vacuum atmosphere.

An average particle diameter of the soft magnetic powder may be 10 to 150 μm.

The soft magnetic powder may be formed by mixing two or more soft magnetic powders having different average particle diameters.

The soft magnetic powder may be formed by mixing a first soft magnetic powder having an average particle diameter of 2 to 5 μm, a second soft magnetic powder having an average particle diameter of 10 to 20 μm, and a third soft magnetic powder having an average particle diameter of 50 to 150 μm.

The soft magnetic powder may include at least one selected from a group consisting of pure iron, carbonyliron, Fe—Si alloy, Fe—Si—Cr alloy, sendust (Fe—Si—Al alloy), permalloy, and Mo-permalloy.

The organic vehicle may be prepared by stirring 50 to 60 wt % of a polymer resin and 40 to 50 wt % of a solvent.

The polymer resin may include at least one selected from a group consisting of an epoxy resin, an epoxy acrylate resin, an acrylic resin, a silicone resin, a phenoxy resin and a urethane resin.

The solvent may include at least one selected from a group consisting of methyl cellosolve, ethyl cellosolve, butyl cellosolve, butyl cellosolve acetate, aliphatic alcohol, terpineol, dihydro-terpineol, ethylene glycol, ethyl carbitol, butyl carbitol, butyl carbitol acetate, texanol, methyl ethyl ketone, ethyl acetate, and cyclohexanone.

The organic vehicle may include at least additive selected from a group consisting of a dispersant, a stabilizer, a catalyst, and a catalyst activator.

Another aspect of the present invention provides a coil-embedded inductor manufactured by the method.

The present invention provides an optimal composition ratio of the soft magnetic powder and the organic vehicle. The present invention has a first effect of having high permeability, a good inductance characteristic, and a low core loss, a second effect of having high reproducibility because the preparation of the soft magnetic molding solution is impossible or the soft magnetic molding solution may flow out of the case by swelling of the polymer when the composition ratio is deviated, a third effect of having an appropriate characteristic in a rheology aspect when the soft magnetic molding solution is injected to the case, a fourth effect in which there is no fear that partial cracks may occur in the magnetic core due to the third effect, a fifth effect in which there is no risk that the soft magnetic powder is removed in the magnetic core because 100% binding of the resin is performed within the composition ratio, a sixth effect of securing reliability due to the fourth effect and the fifth effect, and a seventh effect in which an appropriate curing density of the soft magnetic molding solution prepared within the composition ratio contributes to high permeability and a low core loss of the magnetic core. Further, the present invention can provide an eighth effect in which in a deforming step in the middle of the process or a vacuum-curing step of the last process, the bubbles in the soft magnetic molding solution are removed to contribute to impact resistance of the magnetic core, a ninth effect in which the inductor can be miniaturized because the soft magnetic powder having high permeability is used, a tenth effect in which inductors having various shapes can be manufactured because the case may have various shapes, an eleventh effect in which manufacturing costs may be reduced because a high-temperature sintering process, a pressurizing process for increasing the density of the magnetic core, or the like is not required, a twelfth effect in which there is no fear that a film of the embedded coil is deteriorated because a pressurizing process, a high-temperature annealing process, or the like is not required, and a thirteenth effect in which productivity is increased due to simplification of the process because a high-temperature sintering process, an annealing process, or the like may be omitted.

According to the embodiment of the present invention, the effects of the present invention are not limited to the above effects and it should be understood that the effects include all effects inferable from the configuration of the invention described in the detailed description or claims of the present invention.

DETAILED DESCRIPTION OF THE EMBODIMENTS

Figure 1:
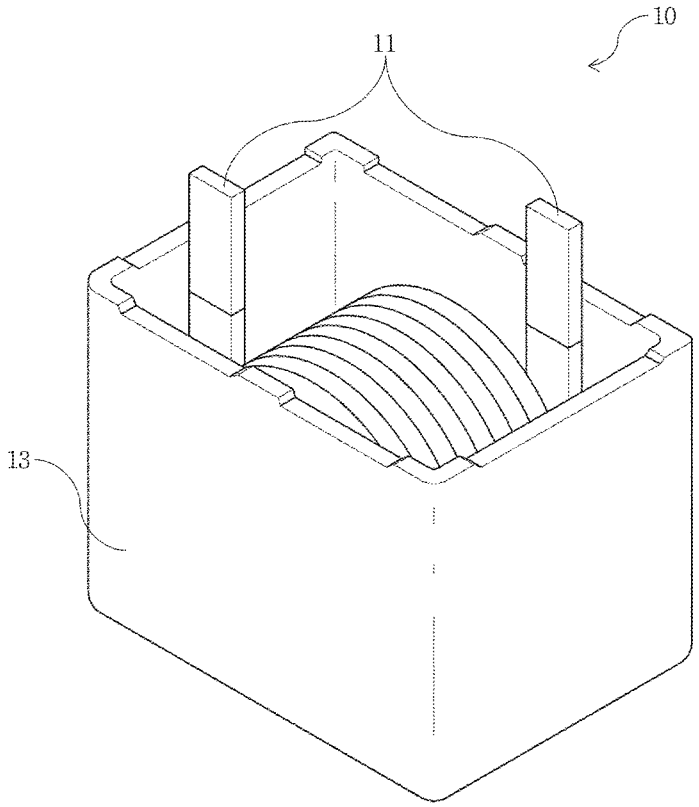
FIG. 1 is a perspective view illustrating a coil-embedded inductor except for a magnetic core according to an embodiment of the present invention.

Hereinafter, the present invention will be described with reference to the accompanying drawings. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

Throughout this specification, when it is described that an element is "connected (bonded, contacted, and coupled)" to another element, the element may be "directly connected" to the other element or "indirectly connected" with the other element interposed therebetween. Throughout the specification and the claims, unless explicitly described to the contrary, the word "comprise" and variations such as "comprises" or "comprising" will be understood to imply the inclusion of stated elements but not the exclusion of any other elements.

Terms used in the present application are used only to describe specific embodiments, and are not intended to limit the present invention. Singular expressions used herein include plural expressions unless they have definitely opposite meanings in the context. In the present application, it should be understood that term "include" or "have" indicates that a feature, a number, a step, an operation, a component, a part or the combination thereof described in the specification is present, but does not exclude a possibility of presence or addition of one or more other features, numbers, steps, operations, components, parts or combinations thereof, in advance.

Figure 2:
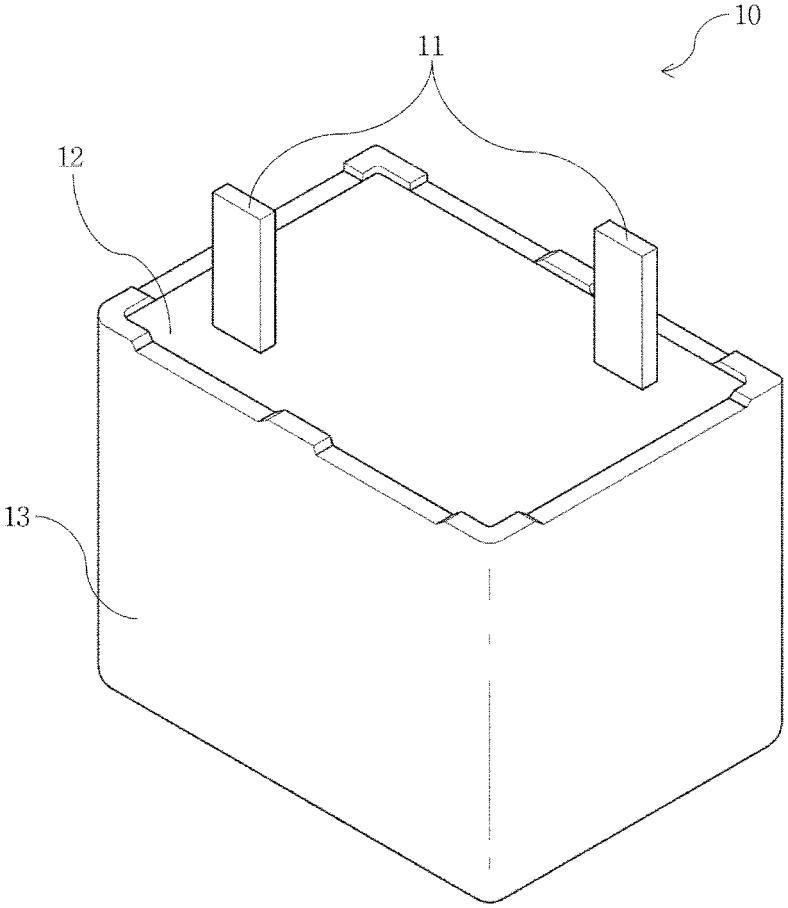
FIG. 2 is a perspective view illustrating a coil-embedded inductor according to an embodiment of the present invention.

A coil-embedded inductor 10 of the present invention includes a coil 11, a magnetic core 12, and a case 13, and in FIG. 1 (the magnetic core 12 is not illustrated) and FIG. 2, perspective views illustrating an example of the coil-embedded inductor 10 are illustrated. As illustrated in FIGS. 1 and 2, the coil-embedded inductor 10 has a structure in which a part of the coil 11 is embedded in the magnetic core 12. A manufacturing method of the coil-embedded inductor 10 having the structure will be described below by each step.

First, an organic vehicle is prepared. The organic vehicle may be prepared by uniformly stirring a predetermined polymer resin and a predetermined solvent under a predetermined temperature condition. In a composition ratio of the polymer resin and the solvent, 50 to 60 wt % of the polymer resin and 40 to 50 wt % of the solvent are provided. When the content of the polymer resin is less than 50 wt % or the content of the solvent is greater than 50 wt %, a binding function of the polymer resin is deteriorated and thus, there may be a problem in the strength of the coil-embedded inductor 10 in that after the soft magnetic molding solution is cured, a soft magnetic powder is partially removed or a partial crack occurs in the magnetic core 12. When the content of the polymer resin is greater than 60 wt % or the content of the solvent is less than 50 wt %, the amount of the polymer resin is excessive and thus, the soft magnetic molding solution may flow out of the case 13 due to swelling of the polymer when the soft magnetic molding solution is cured. Further, the components of the organic vehicle may have an effect on the curing density of the soft magnetic molding solution, and in the organic vehicle, if a ratio of a high-density material is increased, the curing density of the soft magnetic molding solution is increased, and if a ratio of a low-density material is increased, the curing density of the soft magnetic molding solution is decreased. However, detailed contents will be described below.

The polymer resin may be at least one polymer resin selected from a group consisting of an epoxy resin, an epoxyacrylate resin, an acrylic resin, a silicone resin, a phenoxy resin and a urethane resin, but is not limited thereto. That is, only one or two or more kinds of polymer resins may be stirred with the predetermined solvent. However, if a kind of polymer resin which is liquid at room temperature is prepared, the polymer resin itself may be the organic vehicle, and if two or more kinds of polymer resins which are liquid at room temperature are prepared, only the two or more kinds of polymer resins are stirred to prepare the organic vehicle. However, even though the polymer resin is liquid at room temperature, it does not mean that the predetermined solvent is not stirred with the polymer resin. The polymer resin functions as a binder for the soft magnetic powder, and the function includes a function of a structure that maintains a shape of the magnetic core 12, a function of providing chemical resistance to various organic solvents, a function capable of maintaining a desired shape by combining and supporting the soft magnetic powder in the organic vehicle and additives, and a function of increasing an insulating property of the magnetic core 12 by filling a space between the soft magnetic powders and reducing an eddy current loss of the magnetic core 12 by increasing specific resistance of the magnetic core 12, but the function is not limited thereto.

The solvent may include at least one selected from a group consisting of methyl cellosolve, ethyl cellosolve, butyl cellosolve, butyl cellosolve acetate, aliphatic alcohol, terpineol, dihydro-terpineol, ethylene glycol, ethyl carbitol, butyl carbitol, butyl carbitol acetate, texanol, methyl ethyl ketone, ethyl acetate, and cyclohexanone, but the present invention is not limited to the above-listed solvents or only organic solvents. The solvent may have an effect on a curing speed of the soft magnetic molding solution, and if the solvent is not appropriate and thus a curing time of the soft magnetic molding solution is increased, the magnetic core 12 is not sufficiently dried and the curing is performed from the surface of the magnetic core 12. As a result, due to the remaining solvent which is not dried in the magnetic core 12, defects such as void or cracks in the magnetic core 12 may occur.

The organic vehicle may include at least one additive selected from a group consisting of a dispersant, a stabilizer, a catalyst and a catalyst activator. When the polymer resin is not uniformly distributed in the solvent and is likely to aggregate, the dispersant is added to prevent the aggregation, and when it is required to suppress a chemical change or state change of the organic vehicle, the stabilizer may be added. In addition, when the polymer resin and the solvent are not smoothly mixed, the reaction may be promoted by the catalyst and the catalyst activator.

The operation of preparing the organic vehicle by stirring the polymer resin and the solvent (including the additives in the case where the additives are added) is performed by using a mechanical stirrer for a predetermined time under a given rpm condition. In the stirring time, there is no upper limit, but it is required to keep in mind for a minimum time for ensuring uniform stirring, and since the stirring time varies according to a kind of polymer resin, a kind of solvent, and a composition between the polymer resin and the solvent, the stirring time needs to be determined according to each case. After stirring, a process of filtering and defoaming impurities of the prepared organic vehicle by using a sieve may be further performed. The defoaming will be described below in detail.

Second, the soft magnetic powder is mix-milled with the organic vehicle to prepare the soft magnetic molding solution.

The soft magnetic powder includes at least one selected from a group consisting of pure iron, carbonyliron, Fe—Si alloy, Fe—Si—Cr alloy, sendust (Fe—Si—Al alloy), permalloy, and Mo-permalloy, but is not limited thereto. The pure iron is not factually 100% pure iron, but although not defined uniformly in all technical fields, iron containing impurities within approximately 0.2% may be referred to as the pure iron. The pure iron or the carbonyliron is a soft magnetic material, but is not used in electric machines except for some special applications. The reason is that saturated magnetic flux density, the permeability, and the like are high and the hysteresis loss is low (relatively higher than that of other soft magnetic materials), but an eddy current loss is large. The problem needs to be overcome by a vehicle having a good insulating property. In the Fe—Si alloy, the Fe—Si—Cr alloy, and the sendust (Fe—Si—Al alloy), silicon (Si) is commonly included in a metal alloy, and if the content of silicon (Si) included in the metal alloy is increased, there is an advantage in that a specific resistance value of the metal alloy is increased to reduce the eddy current loss, but when the content is excessively increased, it should be noted that brittleness is increased to cause a problem in impact resistance of the magnetic core 12. The Mo-permalloy has high permeability and a very low hysteresis loss, but has a relatively small saturated magnetic flux density, and thus it should be noted that stability is not sufficient at high direct current overlapping and a used frequency is 1 MHz or less.

An average particle diameter of the soft magnetic powder is 10 to 150 μm. When the average particle diameter of the soft magnetic powder is greater than 150 μm, a filling rate of the soft magnetic powder is low and thus the curing density may be decreased and there is a problem in that when the soft magnetic molding solution is injected to the case 13, nozzles of a dispenser may be clogged. When the average particle diameter of the soft magnetic powder is less than 10 μm, the eddy current loss of the magnetic core 12 may be a problem, and there is a problem in the strength of the magnetic core 12 because the organic vehicle is not sufficiently filled in the space between the soft magnetic powders.

The soft magnetic powder may be configured by mixing two kinds or more of soft magnetic powders having different average particle diameters. As such, soft magnetic powders having small average particle diameters are positioned between soft magnetic powders having large average particle diameters, and as a result, the curing density of the soft magnetic molding solution may be increased.

The curing density of the soft magnetic molding solution will be described below. In the mixing of two or more kinds of soft magnetic powders having different average particle diameters, a first soft magnetic powder having an average diameter of 2 to 5 μm, a second soft magnetic powder having an average diameter of 10 to 20 μm, and a third soft magnetic powder having an average diameter of 50 to 150 μm are mixed. In this case, the reason is that soft magnetic powders having small average particle diameters may be positioned between soft magnetic powders having large average particle diameters.

The soft magnetic molding solution may consist of a composition ratio of 94 to 98 wt % of the soft magnetic powder and 2 to 6 wt % of the organic vehicle. When the soft magnetic powder is greater than 98 wt % or the organic vehicle is less than 2 wt %, the amount of the soft magnetic powder is excessive and thus the preparation itself of the soft magnetic molding solution by filling the soft magnetic powder may be impossible. When the amount of the organic vehicle is too low, flowability of the soft magnetic molding solution is low in a rheology aspect when the soft magnetic molding solution is injected into the case 13 and as a result, partial cracks in the magnetic core 12 may occur. In addition, a binding function of the polymer resin is deteriorated and as a result, after curing the soft magnetic molding solution, the soft magnetic powder may be partially removed and the eddy current loss of the magnetic core 12 may be increased. When the soft magnetic powder is less than 94 wt % or the organic vehicle is greater than 6 wt %, it is advantageous in a rheology aspect, but since the amount of the organic vehicle is excessive and thus the filling amount of the soft magnetic powder is decreased, the permeability of the magnetic core 12 is deteriorated and as a result, an inductance characteristic of the coil-embedded inductor 10 may be deteriorated. In addition, the amount of the polymer resin is excessive and thus when the soft magnetic molding solution is cured, the soft magnetic molding solution may flow out of the case 13 by swelling of the polymer.

Further, one of performance conditions of the soft magnetic molding solution may be referred to as the curing density of the soft magnetic molding solution, and the curing density of the soft magnetic molding solution is directly related to the composition ratio of the soft magnetic powder and the organic vehicle. If it is considered that the density of the soft magnetic powder is larger than the density of the organic vehicle, as the ratio of the soft magnetic powder is increased, the density of the soft magnetic molding solution is increased, and this means that the permeability of the soft magnetic molding solution is increased. On the contrary, as the ratio of the soft magnetic powder is decreased, the density of the soft magnetic molding solution is decreased, and this means that the permeability of the soft magnetic molding solution is decreased, but the eddy current loss is decreased. In terms of the permeability and the eddy current loss, it is provided that the density of the soft magnetic molding solution is 5.5 to 6.5 g/cc. As a result, high permeability may be generally secured, and simultaneously, the eddy current loss may be somewhat decreased. One of component reliability as other performance conditions of the soft magnetic molding solution may be heat resistance. In the inductor and the like to which the magnetic core 12 is applied, heat at about 130° C. is generally generated, but exceptionally, when high-frequency noise occurs or an abnormal current is generated, heat at 180° C. or more may be generated around the coil 11. Even though the inductor and the like are repetitively exposed at the temperature, generation of cracks, discoloration, reduction in adhesion with the coil 11, and the like need not to occur, and as a result, the polymer resin needs to satisfy heat resistance.

In the mix-milling of the soft magnetic powder and the organic vehicle, the soft magnetic powder and the organic vehicle are weighted and added in a mix-miller and mix-milled for a predetermined time to be uniformly mixed. In a required time of the mix-milling process, there is no upper limit, but a minimum time for securing uniform mix-milling is required, and since the minimum time varies according to a kind of soft magnetic powder, a component and a composition of the organic vehicle, a composition between the soft magnetic powder and the organic vehicle, the minimum time needs to be determined according to each case.

Before a next process, in order to promote the curing of the soft magnetic molding solution, a curing agent and/or a curing accelerator may be added to the soft magnetic molding solution. The curing agent may use aliphatic amine, modified aliphatic amine, aromatic amine, and modified aromatic amine of amines, acid anhydride, polyamide, and imidazole and the curing accelerator may use Lewis acid, alcohol, phenol, acetyl phenol, carboxylic acid, tertiary amine, and imidazoles, but the present invention is not limited thereto. A time required when curing the soft magnetic molding solution may be shortened by using the curing agent and the curing accelerator.

Further, before a next process, the soft magnetic molding solution may be defoamed. The defoaming is removing bubbles included in the soft magnetic molding solution, and through the process of removing the bubbles, the inductance loss of the coil-embedded inductor 10 may be improved. Further, the bubbles in the soft magnetic molding solution may deteriorate impact resistance of the magnetic core 12 and induce cracks in the magnetic core 12 when moisture penetrates into the bubbles, and thus the defoaming process of the soft magnetic molding solution may be very important. In the method of defoaming the soft magnetic molding solution, the soft magnetic molding solution may be defoamed by rotation and revolution by using a stirring defoamer which may be commercially purchased, but the present invention is not limited to the method.

Third, a part of the coil 11 is positioned and fixed in the case 13. FIG. 1 illustrates an appearance in which a part of the coil 11 is fixed to the case 13. Most of the coil 11 is embedded in the magnetic core 12, but the remaining part is exposed to the outside of the magnetic core 12 to serve as an external terminal (electrode). Of course, the part that serves as the external terminal is provided as a separate member, and the member may be considered as a configuration which is electrically bonded to the coil 11, but in an example in FIG. 1, the coil 11 directly serves as the electrode without providing a separate member that serves as the external terminal. The electrode needs to basically have an anode and a cathode to apply voltage, and thus, two electrodes are required, but the electrode may be further required according to a circuit configuration to be implemented. As illustrated in FIG. 1, the coil 11 may be fixed to the center of the case 13 at a predetermined distance from the bottom and four sides of the case 13, but the fixing position of the coil 11 is not limited thereto. As illustrated in FIG. 1, when the coil 11 is fixed, an apparatus that fixes the coil 11 at the top which is spaced apart from the case 13 at a predetermined distance may be considered so that the coil 11 is not shaken, but the present invention is not limited thereto. Further, when a part of the coil 11 is fixed to the inside of the case 13, the part of the coil 11 needs to be firmly fixed to a position to be fixed. The part of the coil 11 prevents the coil 11 from deviating from the inside of the magnetic core 12, prevents the coil 11 from being shaken in the magnetic core 12, and prevents a gap between the coil 11 and the magnetic core 12 from being generated, but the present invention is not limited to the above reasons.

Fourth, the magnetic core 12 is formed by injecting and curing the soft magnetic molding solution into the case 13. FIG. 2 illustrates the coil-embedded inductor 10 in which the magnetic core 12 is formed by curing the soft magnetic molding solution. The method of injecting the soft magnetic molding solution into the case 13 may use a dispenser, but the present invention is not limited thereto. The method of curing the injected soft magnetic molding solution may be vacuum-curing in which the soft magnetic molding solution is cured in a vacuum atmosphere, but the present invention is not limited thereto. In the case of vacuum-curing the soft magnetic molding solution, there is an advantage in that the bubbles in the soft magnetic molding solution may be removed, and when the vacuum-curing is performed by appropriately setting a temperature, a curing time, and the like, the bubbles in the soft magnetic molding solution may be fully removed.

An example of the coil-embedded inductor 10 manufactured by the manufacturing method of the coil-embedded inductor 10 described above is illustrated in FIG. 2, and the coil-embedded inductor 10 except for the magnetic core 12 in FIG. 2 is illustrated in FIG. 1. As illustrated in FIGS. 1 and 2, in the coil 11, a ring-shaped portion except for two external terminals of the coil 11 may be completely embedded in the magnetic core 12, the case 13 may have a hexahedral shape of which one side in a direction of two external terminals of the coil 11 is opened and parts of edges are chamfered, and the magnetic core 12 may have the shape of the inside of the case 13 as it is, but of course, the shape of the coil-embedded inductor 10 is not limited thereto. Hereinafter, Examples and Test Examples of the coil-embedded inductor 10 will be described below.

Example 1—Manufacturing of Coil-Embedded Inductor 10 by 94 wt % of Soft Magnetic Powder <Preparation of Soft Magnetic Molding Solution>

As the organic vehicle, 3.5 wt % of a urethane modified epoxy vehicle and 2.5 wt % of a polyol epoxy vehicle were selected and stirred. As the soft magnetic powder, 94 wt % of a sendust powder was prepared, and the sendust powder was prepared by mixing a first sendust powder having an average particle diameter of 50 to 150 μm, a second sendust powder having an average particle diameter of 10 to 20 μm and a third sendust powder having an average particle diameter of 2 to 5 μm at a ratio of 2:2:1. The organic vehicle and the soft magnetic powder prepared above were mix-milled for 30 minutes by using a double planetary mixer (DPM) to prepare a soft magnetic molding solution.

<Preparation of Coil-Embedded Inductor 10>

100 g of the soft magnetic molding solution was added with 1.20 g of a curing agent (modified aliphatic amine) and 0.17 g of a curing accelerator (third amine) and deformed by using a stirring deformer (PTE-003) at room temperature. Next, as illustrated in FIG. 1, the soft magnetic molding solution was completely filled in the case 13 fixed with the coil 11 and then the case 13 was input in a vacuum oven, and the soft magnetic molding solution was cured at 175° C. for 1 hr.

Example 2—Manufacturing of Coil-Embedded Inductor 10 by 96 wt % of Soft Magnetic Powder A composition of the organic vehicle was 2.5 wt % of an urethane modified epoxy vehicle and 1.5 wt % of a polyol epoxy vehicle, and Example 2 was implemented under the same condition as Example 1 except that the soft magnetic powder was 96 wt %.

Example 3—Manufacturing of Coil-Embedded Inductor 10 by 98 wt % of Soft Magnetic Powder A composition of the organic vehicle was 1.5 wt % of an urethane modified epoxy vehicle and 0.5 wt % of a polyol epoxy vehicle, and Example 3 was implemented under the same condition as Example 1 except that the soft magnetic powder was 98 wt %.

Comparative Example 1—Manufacturing of Coil-Embedded Inductor 10 by 93 wt % of Soft Magnetic Powder A composition of the organic vehicle was 4.0 wt % of an urethane modified epoxy vehicle and 3.0 wt % of a polyol epoxy vehicle, and Comparative Example 1 was implemented under the same condition as Example 1 except that the soft magnetic powder was 93 wt %.

Comparative Example 2—Manufacturing of Coil-Embedded Inductor 10 by 99 wt % of Soft Magnetic Powder A composition of the organic vehicle was 1.0 wt % of a urethane modified epoxy vehicle, and Comparative Example 2 was implemented under the same condition as Example 1 except that the soft magnetic powder was 99 wt %.

Test Examples

Initial permeability and effective permeability (when 0 Oe, 200 Oe, and 400 Oe) of the coil-embedded inductors 10 manufactured in Examples 1 to 3 and Comparative Examples 1 and 2 were measured by an impedance analyzer (HP4249A) and a high current meter (DPG10), and the core loss of the coil-embedded inductors 10 was measured by using a B-H analyzer (SY-8217). The result thereof was illustrated in Table 1 below.

TABLE 1

| | | Comparative Example 1 | Example 1 | Example 2 | Example 3 | Comparative Example 2 |
|---|---|---|---|---|---|---|
| Initial permeability ($\mu_i$) | | 8.52 | 22.31 | 22.52 | 22.60 | 9.73 |
| Effective permeability ($\mu_e$) | 0 [Oe] | 8.52 | 22.31 | 22.52 | 22.60 | 9.73 |
| | 200 [Oe] | 7.39 | 15.62 | 16.54 | 17.12 | 8.44 |
| | 400 [Oe] | 6.99 | 10.43 | 11.51 | 12.01 | 7.52 |
| Core loss (mW/cm$^3$) (f: 100 kHz, B: 500 [Oe]) | | 1105 | 403 | 404 | 405 | 1130 |

As seen in Table 1, when the soft magnetic powder was 94 to 98 wt % (2 to 6 wt % of the organic vehicle), the initial permeability and the effective permeability were high and the core loss (mainly a loss due to an ebby current) was low. However, when the soft magnetic powder was 93 wt % (7 wt % of the organic vehicle) or 99 wt % (1 wt % of the organic vehicle), the initial permeability and the effective permeability were relatively low and the core loss was high.

The present invention is described together with the accompanying drawings, but is just one embodiment among various embodiments including the gist of the present invention and an object of the present invention is for to those skilled in the art to easily implement the present invention and it is apparent that the present invention is limited only to the described embodiment. Therefore, the protection scope of the present invention should be interpreted by the appended claims and all technical spirits within the scope equivalent to modification, replacement, substitution, and the like will be included in the claims of the present invention by modification, replacement, substitution, and the like within the scope without departing from the gist of the present invention. Further, some components of the drawings are used for more clearly describe the components and it is apparent that some components are provided while being larger or smaller than actual components.

DESCRIPTION OF REFERENCE NUMERALS

10: coil-embedded inductor
11: coil
12: magnetic core
13: case

What is claimed is:

1. A manufacturing method of a coil-embedded inductor having a structure in which a part of a coil is embedded in a magnetic core, the manufacturing method comprising:

(I) preparing an organic vehicle;

(II) preparing a soft magnetic molding solution having a density of 5.5 to 6.5 g/cc by mix-milling a soft magnetic powder with the organic vehicle;

(III) positioning and fixing a part of the coil in a case; and (IV) forming the magnetic core by injecting and curing the soft magnetic molding solution into the case, wherein the soft magnetic molding solution in step (II) is formed with a composition ratio of 94 to 98 wt % of the soft magnetic powder and 2 to 6 wt % of the organic vehicle, wherein the soft magnetic powder is formed by mixing three or more soft magnetic powders having different average particle diameters, and wherein the soft magnetic powder is formed by mixing a first soft magnetic powder having an average particle diameter of 2 to 5 μm, a second soft magnetic powder having an average particle diameter of 10 to 20 μm, and a third soft magnetic powder having an average particle diameter of 50 to 150 μm.

2. The manufacturing method of claim 1, comprising:

adding a curing agent or a curing accelerator to the soft magnetic molding solution, between step (II) and step (III).

3. The manufacturing method of claim 1, wherein in step (IV), the soft magnetic molding solution is cured in a vacuum atmosphere.

4. The manufacturing method of claim 1, wherein an average particle diameter of the soft magnetic powder is 10 to 150 μm.

5. The manufacturing method of claim 1, wherein the soft magnetic powder includes at least one selection from a group consisting of pure iron, carbonyliron, Fe—Si alloy, Fe—Si—Cr alloy, sendust (Fe—Si—Al alloy), permalloy, and Mo-permalloy.

6. The manufacturing method of claim 1, wherein the organic vehicle in step (I) is prepared by stirring 50 to 60 wt % of a polymer resin and 40 to 50 wt % of a solvent.

7. The manufacturing method of claim 6, wherein the polymer resin includes at least one selection from a group consisting of an epoxy resin, an epoxy acrylate resin, an acrylic resin, a silicone resin, a phenoxy resin and a urethane resin.

8. The manufacturing method of claim 6, wherein the solvent includes at least one selection from a group consisting of methyl cellosolve, ethyl cellosolve, butyl cellosolve, butyl cellosolve acetate, aliphatic alcohol, terpineol, dihydro-terpineol, ethylene glycol, ethyl carbitol, butyl carbitol, butyl carbitol acetate, texanol, methyl ethyl ketone, ethyl acetate, and cyclohexanone.

9. The manufacturing method of claim 1, wherein the organic vehicle in step (I) includes at least additive selected from a group consisting of a dispersant, a stabilizer, a catalyst, and a catalyst activator.

10. A coil-embedded inductor manufactured by the method of claim 1.

* * * * *